US009200351B2

(12) United States Patent
Mol de Oliveira et al.

(10) Patent No.: US 9,200,351 B2
(45) **Date of Patent: *Dec. 1, 2015**

(54) HIGH RESISTANCE GRAY IRON ALLOY FOR COMBUSTION ENGINES AND GENERAL CASTS

(75) Inventors: Otto Luciano Mol de Oliveira, Betim-MG (BR); Jefferson Pinto Villafort, Betim-MG (BR)

(73) Assignee: TEKSID DO BRASIL LTDA., Betim/Mg (BR)

( * ) Notice: Subject to any disclaimer, the term of this patent is extended or adjusted under 35 U.S.C. 154(b) by 0 days.

This patent is subject to a terminal disclaimer.

(21) Appl. No.: 13/201,337

(22) PCT Filed: Feb. 12, 2009

(86) PCT No.: PCT/BR2009/000045

§ 371 (c)(1), (2), (4) Date: Oct. 19, 2011

(87) PCT Pub. No.: WO2010/091487

PCT Pub. Date: Aug. 19, 2010

(65) Prior Publication Data

US 2012/0027636 A1 Feb. 2, 2012

(51) Int. Cl.

| | |
|---|---|
| ***C22C 37/06*** | (2006.01) |
| ***C22C 37/00*** | (2006.01) |
| ***C22C 37/10*** | (2006.01) |

(52) U.S. Cl.

CPC ..... *C22C 37/00* (2013.01); *C22C 37/10* (2013.01)

(58) Field of Classification Search

CPC ..... C22C 37/10; C22C 37/00
USPC ..... 420/13, 15
See application file for complete search history.

(56) References Cited

U.S. PATENT DOCUMENTS

| | | | | |
|---|---|---|---|---|
| 4,401,469 | A * | 8/1983 | Rehder | 420/33 |
| 2008/0206584 | A1 * | 8/2008 | Jaszarowski et al. | 428/544 |

FOREIGN PATENT DOCUMENTS

| | | | |
|---|---|---|---|
| FR | 1466328 | * | 1/1967 |
| JP | 60052516 | | 3/1985 |
| JP | 10096040 | | 4/1998 |
| WO | 2004083474 | | 9/2004 |

OTHER PUBLICATIONS

Collini et al., "Microstructure and mechanical properties of pearlitic gray cast iron," Materials Science and Engineering A (2008) 488:529-539.

* cited by examiner

*Primary Examiner* — Rebecca Lee
(74) *Attorney, Agent, or Firm* — Volpe and Koenig, P.C.

(57) ABSTRACT

The object of this application defines a new alloy which presents at the same time the mechanical and physical properties of the gray iron alloy, i.e., excellent machinability, damping vibration, thermal conductivity, low shrink tendency and good microstructure stability, together with a wide interface range of the CGI tensile strength.

1 Claim, 4 Drawing Sheets

(X100)

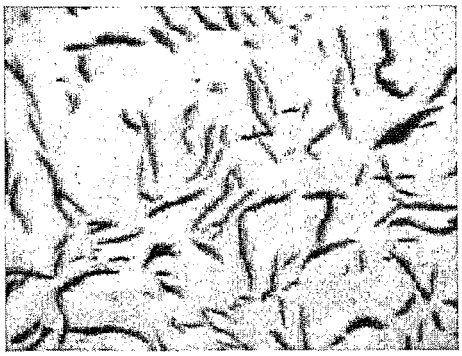
Figure 1 (X100)
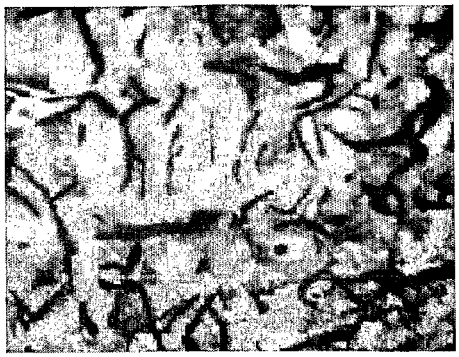
Figure 2 (X100)
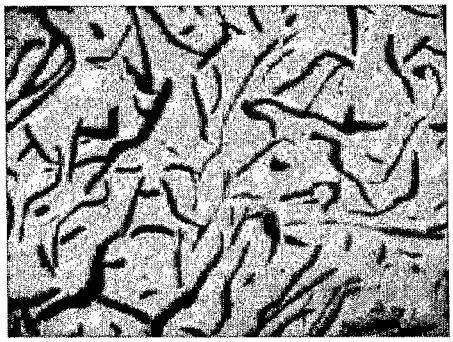
Figure 3 (X100)
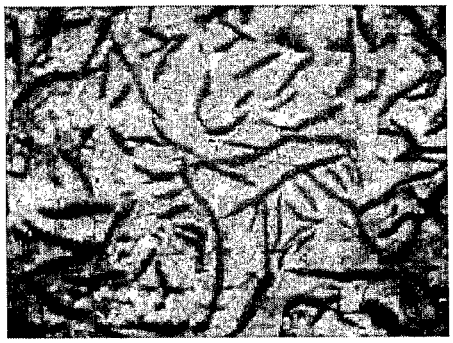
Figure 4 (X100)
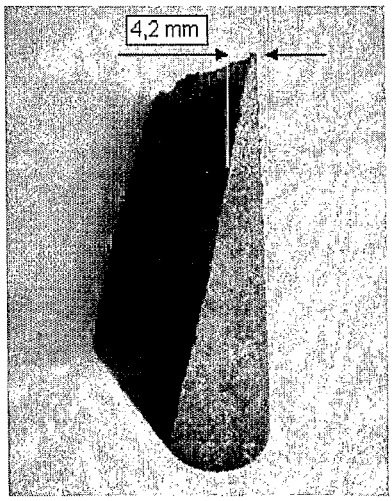
Figure 5
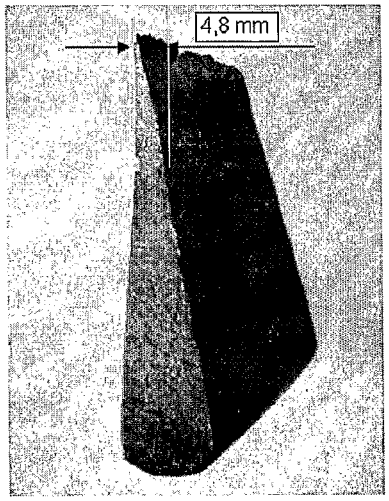
Figure 6

2.3.4 Nomogramm zur Bestimmung des Kohlenstoff- und Siliziumgehaltes in untereutektischen Gußeisenschmelzen mit Hilfe der thermischen Analyse, $S_c < 1$

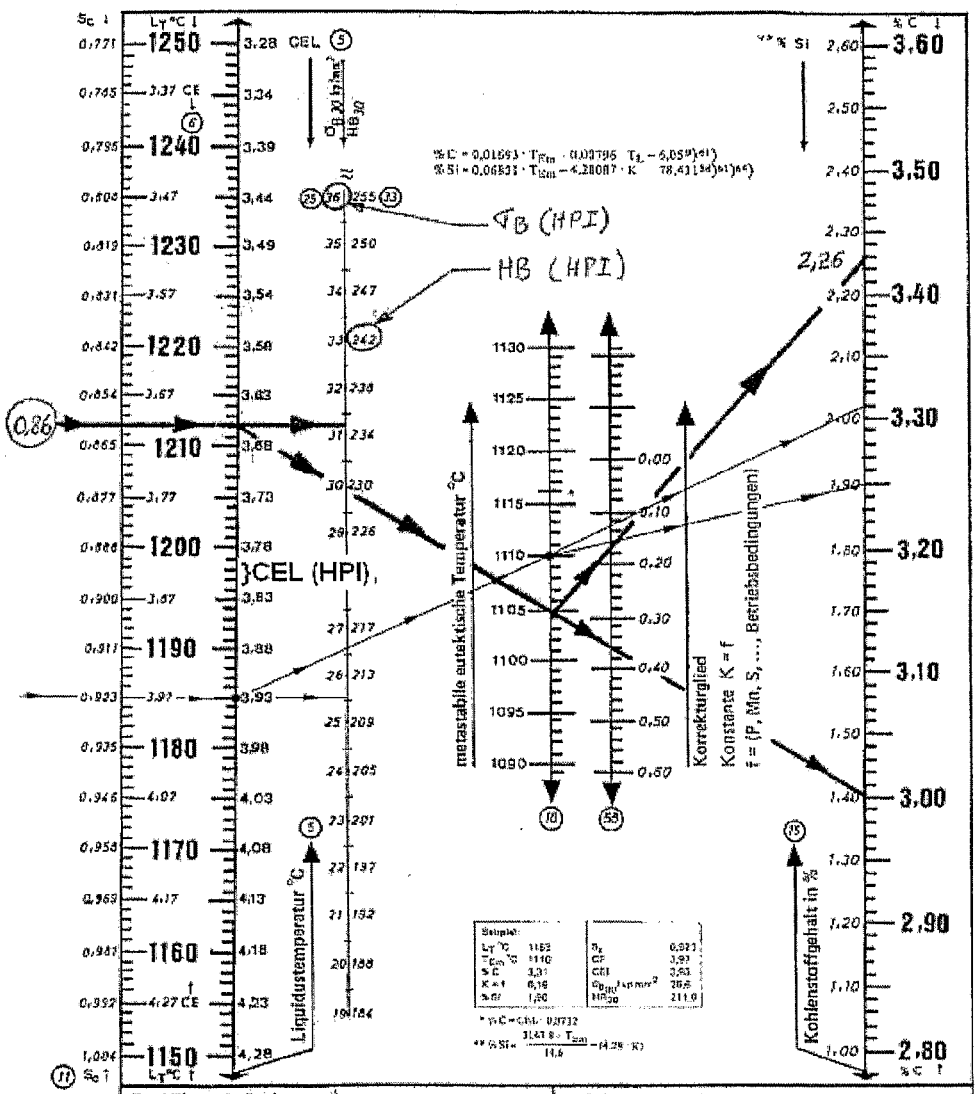

Durchführung der Bestimmung [1]

1. Beim Abkühlen einer Gußeisenprobe in einem tellurbeschichteten Meßtiegel wird die Weißerstarrung sichergestellt. Weißerstarrung kann für magnesium- oder cerbehandeltes Eisen nicht garantiert werden, gelegentlich können auch bei stark geimpftem Gußeisen Schwierigkeiten auftreten. Die Methode ist für jedes unlegierte Eisen anzuwenden, wenn die Zusammensetzung im Bereich von $C + Si/9 + P/3{,}5 < 4{,}3\%$ liegt.
2. Die Abkühlungskurve muß eine Form ähnlich der idealen Kurve haben (vgl. *Bild 1b*).

[1] Hartung, W.: Gießerei 57 (1970) Nr. 24, S. 753/56.
[2] Moore, A.: Foundry 102 (1974) Nr. 7, S. 80/83.

| Programm | | | |
|---|---|---|---|
| HP-97 | GG 1-8 | A + B | |
| HP-67 | GG 2-8 | A + B | |
| HP-41 C | GG 8 - | A + B | |
| CASIO FX-602 P | GG 108 | A + B | |

(mathematische Grundlagen siehe S. 01)

© Friedr. Vieweg & Sohn, Braunschweig/Wiesbaden

Figure 9

HIGH RESISTANCE GRAY IRON ALLOY FOR COMBUSTION ENGINES AND GENERAL CASTS

This application is a 35 U.S.C. §371 national phase application of PCT/BR2009/000045, which was filed Feb. 12, 2009 and is incorporated herein by reference as if fully set forth.

The present invention defines a new class of gray iron alloy, with a higher tensile strength, while keeping the machinability conditions compatible with traditional gray iron alloys. More specifically, the material produced can be used either in combustion engines with high compression rates, or in general casts and traditional combustion engines where weight reduction is a target.

STATE OF THE ART

Gray iron alloys, known since the end of XIX century, have become an absolute success in the automotive industry due to their outstanding properties, mainly required by combustion engines. Some of these gray iron alloy characteristics have been recognized for a long time as presenting:

- Excellent thermal conductivity
- Excellent damping vibration capacity
- Excellent machinability level
- Relatively small shrink rate (low tendency for internal porosities on the casts)
- Good thermal fatigue level (when using a Molybdenum based alloy)

However, due to the increasing requirements of combustion engines such as more power, lower fuel consumption and lower emissions for environmental purposes, the traditional gray iron alloys hardly achieve the minimum tensile strength required by combustion engines with higher compression rates. Generally, as a simple reference, such tensile strength requirements start at a minimum 300 MPa, at main bearing location on cylinder blocks or at fire face location on cylinder heads.

Precisely the big limitation of the current gray iron alloys is that they present a drastic decrease of machinability properties when higher tension is required.

Thus, in order to solve such problem, some metallurgists and material experts decided to focus on a different alloy: compact graphite based, usually known as compact graphite iron (CGI). Many papers discuss the CGI properties:

- R. D. Grffin, H. G. Li, E. Eleftheriou, C. E. Bates, "Machinability of Gray Cast Iron". Atlas Foundry Company (Reprinted with permission from AFS)
- F. Koppka e A. Ellermeier, "0 Ferro Fundido de Grafita Vermicular ajuda a dominar altas pressões de combustão", Revista MM, january/2005.
- Marquard, R & Sorger, H. "Modern Engine Design". CGI Design and Machining Workshop, Sintercast—PTW Darmstadt, Bad Homburg, Germany, November 1997.
- Palmer, K. B. "Mechanical properties of compacted graphite iron". BCIRA Report 1213, pp 31-37, 1976
- ASM. Speciality handbook: cast irons. United States: ASM International, 1996, p. 33-267.
- Dawson, Steve et al. The effect of metallurgical variables on the machinability of compacted graphite iron. In: Design and Machining Workshop—CGI, 1999.

Indeed, several patents applications have been required regarding CGI process:

- U.S. Pat. No. 4,667,725 of May 26, 1987 in the name of Sinter-Cast AB (Viken, SE). A method for producing castings from cast-iron containing structure-modifying additives. A sample from a bath of molten iron is permitted to solidify during 0.5 to 10 minutes.
- WO9206809 (A1) of Apr. 30, 1992 in the name of SINTERCAST LTD. A method for controlling and correcting the composition of cast iron melt and securing the necessary amount of structure modifying agent.

Although the CGI alloy presents outstanding tensile strength, it also presents other serious limitations regarding its properties or industrialization. Among such limitations, we can emphasize:

- Lower thermal conductivity;
- Lower damping vibration capacity;
- Lower machinability level (hence, higher machining costs);
- Higher shrink rate (hence, higher tendency for internal porosities); and
- Lower microstructure stability (strongly dependent on the cast wall thickness).

In this scenario, the challenge was to create an alloy that keeps the similar outstanding properties of the gray iron alloy, concomitantly with a wide tensile strength interface of the CGI alloy. This is the scope of the present invention.

Currently, the method to obtain a gray iron cast, in the foundries, has the following steps:

- Melting Phase: the load (scraps, pig iron, steel, etc) is melted by cupola, induction or arc furnaces.
- Chemical Balance: usually performed on the liquid batch inside the induction furnace, in order to adjust the chemical elements (C, Si, Mn, Cu, S, etc) according to the required specification.
- Inoculation Phase: commonly carried out at the pouring ladle or at the pouring mold operation (when using pouring furnaces), in order to promote enough nucleus to avoid the undesirable carbide formation.
- Pouring Phase: carried out on the molding line at a pouring temperature usually defined in a range to prevent blow holes, burn in sand and shrinkage after the cast solidification. In other words, the pouring temperature is actually defined as a function of the cast material soundness.
- Shake-Out Phase: usually performed when the cast temperature, inside the mold, cools comfortably under the eutectoidic temperature (≈700° C.).

Such a process is applied at foundries worldwide and has been object of many books, papers and technical articles:

- Gray Iron Founders' Society: Casting Design, Volume II: Taking Advantage of the Experience of Patternmaker and Foundryman to Simplify the Designing of Castings, Cleveland, 1962.
- Straight Line to Production: The Eight Casting Processes Used to Produce Gray Iron Castings, Cleveland, 1962. Henderson, G. E. and Roberts,
- Metals Handbook, 8th Edition, Vols 1, 2, and 5, published by the American Society for Metals, Metals Park, Ohio.
- Gray & Ductile iron Castings Handbook (1971) published by Gray and Ductile Iron Founders Society, Cleveland, Ohio.
- Gray. Ductile and Malleable, Iron Castings Current Capabilities. ASTM STP 455, (1969)
- Ferrous Materials: Steel and Cast Iron by Hans Berns, Werner Theisen, G. Scheibelein, Springer; 1 edition (Oct. 24, 2008)
- Microstructure of Steels and Cast Irons Madeleine Durand-Charre Springer; 1 edition (Apr. 15, 2004)
- Cast Irons (Asm Specialty Handbook) ASM International (Sep. 1, 1996)

Many patent applications reveal compositions with the usual components on gray iron alloys, also applied to the present application. However, comparing to our application, they not present all the components and/or equations that are mandatory to regulate the precise balance between some specifics components in the final composition.

Examples of that is the PCT application WO 2004/083474 of a Volvo composition with the mandatory presence of N in its composition (not applied in our application) or the Japanese application JP 10096040 with the requirement of Ca in its composition (not applied in the present invention). Besides, it is important to inform that the composition of those applications defines ranges of variations in several components that are too wide. If applied in the present invention would deteriorate the main material properties.

Other example is the European Patent EP 0616040 for the desulphurization of a gray cast alloy. In this European application the component "S" must be eliminated. Differently, the present invention requires the "S" component as important factor to generate the necessary nucleus.

ABSTRACT

The object of the present application is to define an alloy, which presents the mechanical and physical properties of the gray iron alloy, with a wide interface range of the CGI's tensile strength. This new alloy, flake graphite based, is a High Performance Iron (HPI) alloy. Therefore, besides its high tensile strength, the HPI alloy presents excellent machinability, damping vibration, thermal conductivity, low shrink tendency and good microstructure stability (compatible with gray iron alloys).

Said HPI's characteristics are obtained by a specific interaction among five metallurgical fundaments: chemical analysis; oxidation of the liquid metal; nucleation of the liquid metal; eutectic solidification and eutectoidic solidification.

BRIEF DESCRIPTION OF THE DRAWINGS

The present application will be explained based on the following non limitative figures:

FIGS. 1 and 2 show the microstructure (unetched and etched) of the HPI alloy;

FIGS. 3 and 4 show the microstructure (unetched and etched) of the traditional gray iron alloy;

FIG. 5 shows a chill test probe before deoxidation process;

FIG. 6 shows a chill test probe after the deoxidation process;

FIG. 9 shows a metallurgical diagram comparing the gray iron alloys and the HPI alloy.

DESCRIPTION OF THE INVENTION

Figure 7:
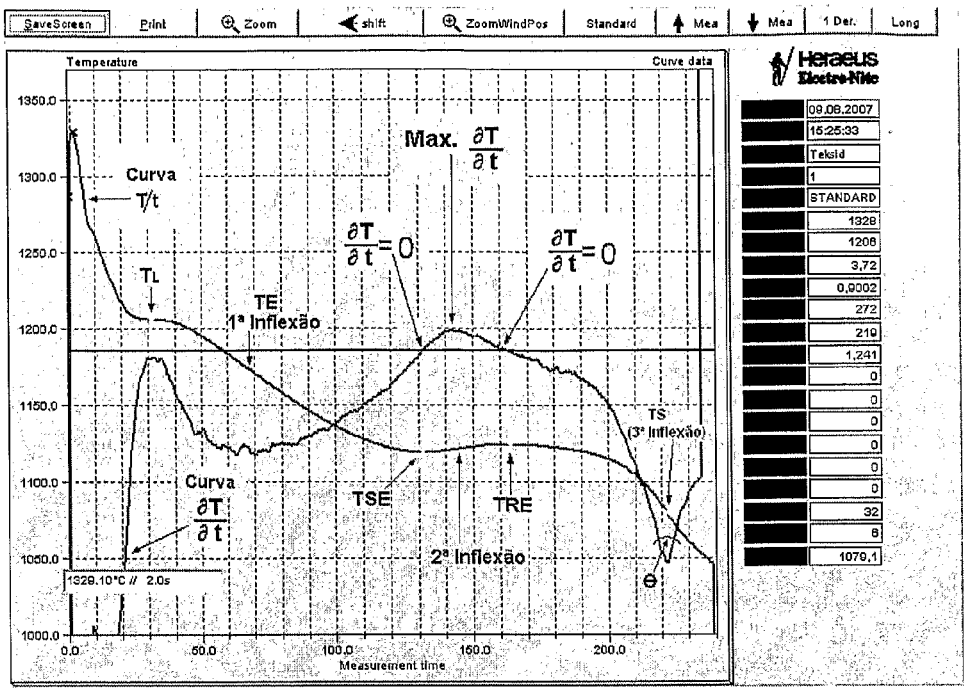
FIG. 7 shows a cooling curve and its derivative for the HPI alloy.

For the purposes of the present invention, Carbon Equivalent (CE) is defined by the following formula "CE=%C+%Si/3+%P/3," which is taught in "*ASM-SpecialtyHandbook," ed. Daves & Associates,* 1996, p. 6-7.

The present invention defines a new alloy, flake graphite based, with the same excellent industrial properties of the traditional gray iron, with higher tensile strength (up to 370 Mpa), which makes this alloy an advantageous alternative if compared with the CGI alloy.

By analytical and practical means, there is an interaction among five metallurgical fundaments: chemical analysis; oxidation level of the liquid batch; nucleation level of the liquid batch; eutectic solidification and eutectoidic solidification. The present alloy allows the obtainment of the best condition from each one of these fundaments in order to produce this new high performance iron alloy, herein called HPI.

Chemical Analysis:

The chemical correction is carried out in traditional ways, at the induction furnace and the chemical elements are the same ones already known by the market: C, Si, Mn, Cu, Sn, Cr, Mo, P and S.

However, the following criteria for the balance of some chemical elements must be kept so that the desirable flake graphite morphology (Type A, size 4 to 7, flakes with no sharp ends), the desirable microstructure matrix (100% pearlitic, max 2% carbides) and the desirable material properties can be obtained:

- The carbon equivalent (CE) is defined in the range from 3.6% to 4.0% in weight but, at the same time, keeping the C content from 2.8% to 3.2%. The HPI alloy has a higher hypoeutectic tendency if compared with the traditional gray iron alloys.
- The Cr content is defined as max 0.4% and, when associated with Mo, the following criterion must be obeyed: % Cr+% Mo0.65%. It will permit the proper pearlitic refinement.
- The Cu and Sn must be associated according to the following criterion: 0.010%≤[% Cu/10+% Sn]≤0.021%)
- The S and Mn contents are defined in specific ranges of the rate % Mn/% S, calculated to guarantee that the equilibrium temperature of the manganese sulfide MnS will always occur under the "liquidus temperature" (preferable near the eutectic starting temperature). Besides improving the mechanical properties of the material, this criterion prompts the nucleus formation inside the liquid batch. Table 1 presents the application of such criterion for a diesel cylinder block where the % Mn was defined between 0.4% and 0.5%.

TABLE 1

| ideal "Mn/S" range, as a function of % Mn | |
|---|---|
| Mn = 0.40% | Ideal Range: Mn/S = 3.3 to 3.9 |
| Mn = 0.47% | Ideal Range: Mn/S = 4.0 to 5.0 |
| Mn = 0.50% | Ideal Range: Mn/S = 4.9 to 6.0 |

The Si content range is defined from 2.0% to 2.40%.

The "P" content is defined as: % P 0.10%.

Pictures 1, 2, 3 and 4 show the compared microstructure between traditional gray iron and HPI alloys, where the graphite morphology and graphite "density" spread in the matrix can be observed.

Oxidation of the Liquid Batch

To obtain the HPI alloy, the liquid batch in the induction furnace must be free of coalesced oxides that do not promote nucleus. Besides, they also must be homogeneous along the liquid batch. So, in order to meet such criterion, a process for deoxidation was developed according to the following steps:

- Increase of the furnace temperature over the silicon dioxide (SiO2) equilibrium temperature;
- Turning off the furnace power for at least 5 minutes to promote the flotation of the coalesced oxides and other impurities;

Spreading of an agglutinating agent on the surface of the liquid batch; and

Removal of such agglutinant material now saturated with the coalesced oxides, leaving cleaner liquid metal inside the furnace.

Despite the fact that this operation decreases the nucleation level (see FIGS. 5 and 6 presenting the chill test probes, before and after the deoxidation process), said steps ensure that only active oxides, promoters of nucleus, remain in the liquid batch. Such operation also increases the effectiveness of the inoculants to be applied later.

Nucleation of the Liquid Batch

Another important characteristic of the HPI alloy when compared to the traditional gray iron alloys is precisely the elevated eutectic cell number. The HPI alloy presents from 20% to 100% more cells if compared with the same cast performed in current gray iron alloys. This higher cells number directly promotes smaller graphite size and, thus, contributes directly to the increase of the tensile strength of the HPI material. In addition, more cell number also implies more MnS formed in the very core of each nucleus. Such phenomenon is decisive to increase tool life when the HPI material is machined.

After the chemical correction and deoxidation process, the liquid batch inside the furnace must be nucleated according to the following method:

Pouring from 15% to 30% of the furnace liquid batch on a specific ladle.

During this operation, inoculating from 0.45% up to 0.60% in % weight of granulated Fe—Si—Sr alloy, right on the liquid metal stream.

Returning the inoculated liquid metal from the ladle to the furnace, keeping the operation with a strong metal flow.

During such operation, the furnace must be kept on "turn on" phase.

Besides creating new nuclei, said method also increases the active oxides number in the liquid metal inside the furnace.

In sequence, the usual inoculation phase is performed in traditional ways, since long time known by the foundries. However, the difference for HPI alloy is precisely the range of % weight of inoculant applied on the pouring ladle or pouring furnace immediately before the pouring operation: From 0.45% to 0.60%. It represents about twice the % of inoculant currently applied in this step to perform traditional gray iron alloys.

The following step is to specify the nucleation of the liquid metal by thermal analysis. The method defines two thermal parameters from the cooling curves as more effective to guarantee a desirable nucleation level:

1) Eutectic Under-Cooling Temperature "Tse" and,

2) Range of Eutectic Recalescence Temperature "ΔT".

Both parameters must be considered together, to define whether the liquid metal is nucleated enough to be compatible with the HPI requirements.

The desirable nucleation of the HPI alloy must present the following values:

Tse→Min 1115° C.; and

ΔT→Max 6° C.

FIG. 7 shows the cooling curve and its derivative from a diesel 6 cylinder block, cast with HPI alloy, where both thermal parameters are met as required by the criterion. Said block presented the tensile strength value of 362 Mpa and hardness of 240 HB at bearing location.

Figure 8:
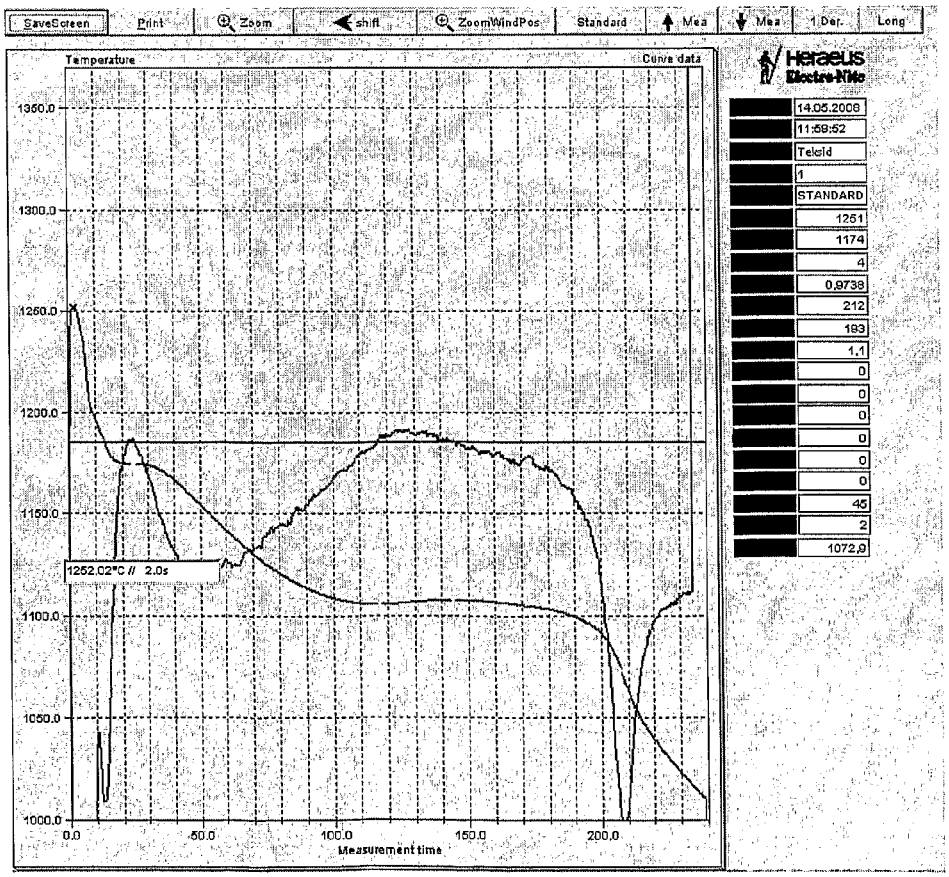
FIG. 8 shows a cooling curve and its derivative for the traditional gray iron alloy.

FIG. 8 shows the cooling curve of the same block, cast with normal gray iron, where the ΔT was found ≈2° C. (matching the HPI nucleation requirement), but the Tse value was 1105° C. (not matching the HPI nucleation requirement). This traditional gray iron block presented the tensile strength value of 249 Mpa and hardness of 235 HB at bearing location.

As a reference, table 2 below presents the comparison of HPI thermal data using two different inoculants:

TABLE 2 comparison data of thermal analysis (° C.) between two inoculants Fe—Si alloy Ba—La based and Sr based

| INOCULANT | TL | TEE | TE | TSE | TRE | ΔT | ΔSN | ΔSC | TS | θ | Max ∂T/∂t |
|---|---|---|---|---|---|---|---|---|---|---|---|
| FeSi—Ba—La | 121 | 1156 | 1181 | 1115 | 1123 | 6 | 41 | 33 | 1081 | Sharp | (X/s) |
| FeSi—Sr | 121 | 1156 | 1176 | 1119 | 1124 | 5 | 37 | 32 | 1079 | Sharp | (X/s) |

The cast applied with Ba—La inoculant presented Ts=346 Mpa and 2% of carbides. On the other hand, the block applied with Sr inoculant presented Ts=361 Mpa with no carbides. It shows the sensibility of the related thermal parameters on the nucleation level of the liquid batch.

Eutectic Solidification:

As a remarkable solidification phenomenon, the eutectic phase represents the birth that characterizes the latter material properties. Many books and papers have approached the eutectic phase in many ways, signaling several parameters such as heat exchange between metal and mold, chemistry, graphite crystallization, recalescence, stable and meta-stable temperatures and so on.

However, the HPI alloy prescribes in the eutectic phase a specific interaction between two critical parameters directly related to the foundry process and to the cast geometry, as follows:

Pouring temperature "Tp"; and

Global solidification modulus of the cast "Mc".

Hence applying a specific calculation, the HPI defines the global cast modulus "Mc", at the range: 1.38≤"Mc"≤1.42, as a function of the best pouring temperature "Tp" (allowed +/−10° C.).

Such criterion allows effective speed for the eutectic cells to grow, to achieve the desirable mechanical and physical properties and mainly to drastically reduce the shrinkage formation when the HPI cast gets solid. In other words, this alloy requires a calculated pouring temperature as a function of the global cast modulus. It is quite different from the common practice where the pouring temperature is usually a function of the cast soundness.

Figure 10:
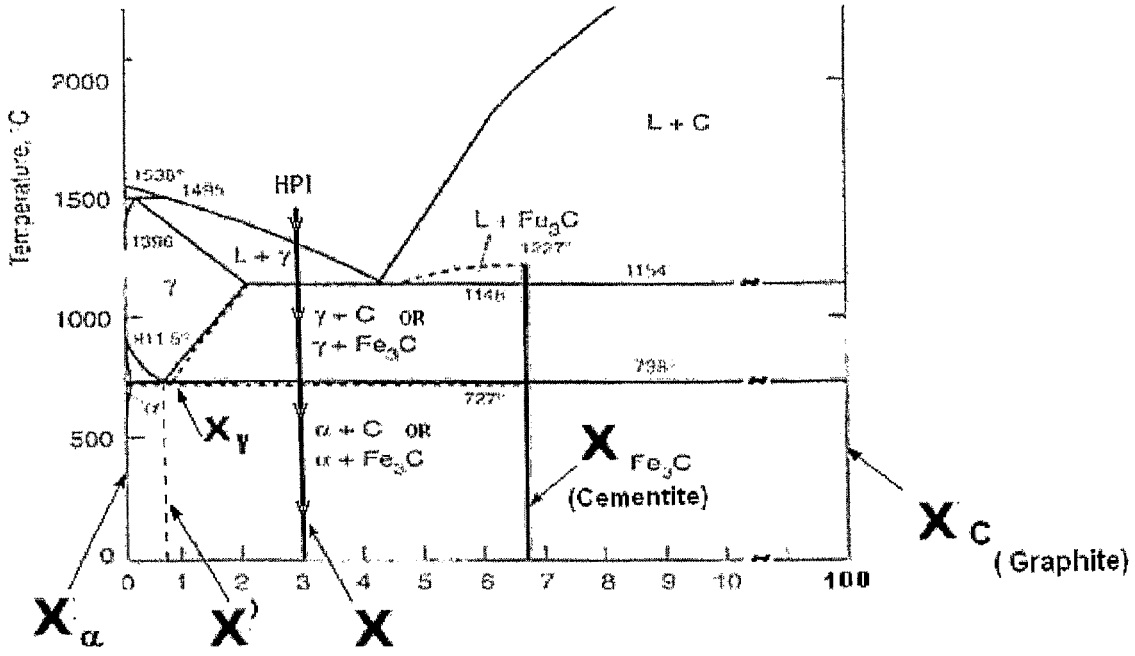
FIG. 10 shows an interfaced Fe—C and Fe—Fe3C equilibrium diagram

Eutectoidic Solidification:

As a solid-solid transformation, the eutectoidic phase shapes the final microstructure of the cast. Then, despite being a flake graphite alloy, the HPI microstructure presents slightly reduced graphite content on its matrix: 2.3% (calculated by the "lever rule" taking as reference the equilibrium diagram Fe—Fe3C, as shown in FIG. 10.

Said range confirms the HPI hypoeutectic tendency that, nonetheless, keeps good machinability parameters by the increased number of eutectic cells. Also, in order to enable the obtainment of pearlite refinement the shake-out operation be done when the cast superficial temperature range is between 400° C. and 680° C., according to the cast wall thickness variation.

Said alloy has some remarkable material property differences in the final microstructure, when compared with traditional gray iron. On the metallurgical diagram data, FIG. 9, said differences are clear when the HPI input data are considered. The thick line in FIG. 9 represents such HPI input data on the diagram, where the corresponding output data are defined considering the traditional gray iron results.

Taking the diagram in FIG. 9 (developed from traditional gray iron alloys), one can visualize such remarkable differences between HPI and normal gray iron properties. As an example, considering the Diesel 6 cylinder block cast by HPI method, the found input data are: "Sc=0.86" (carbon saturation); TL=1210° C. (Liquidus Temperature) and C=3.0% (Carbon content). Remarks:

When the thick line crosses the tensile scale, the theoretical gray iron should present the uncommon value of ≈30 Kg/mm$^2$. Instead, the HPI prototype presented the real value of 36 Kg/mm$^2$. If we consider that a typical market gray iron hardly reaches above 28 Kg/mm$^2$ (for cylinder blocks or heads), it is easy to observe here the first difference between both alloys.

Observing now the hardness scale on FIG. 9 diagram, we can see that if such theoretical gray iron alloy presents the tensile value ≈35 Kg/mm$^2$, the related hardness value should be ≈250 HB. However, the HPI prototype cylinder block with the real tensile value of 36 Kg/mm$^2$, presented the hardness value ≈240 HB. In other words, even presenting the same or higher tensile value, the HPI alloy has a clear tendency to have lower hardness if compared with a theoretical gray iron alloy with the same tensile value.

If we still take the same theoretical gray iron with the tensile value ≈35 Kg/mm$^2$, the related carbon equivalent value (CEL) on FIG. 9 diagram presents the very low value of ≈3.49%. Instead, the HPI cylinder block prototype with 36 Kg/mm$^2$ has CEL=3.80%, which means that, keeping the same tensile value for both alloys, the HPI alloy has a remarkable low shrinkage tendency.

The remarks above explain why we do not find on the market high resistance traditional gray iron to be used in cylinder blocks or heads; If such alloy were applied, it would present serious machinability and soundness problems (similar to CGI alloy). The purpose of the HPI alloy is exactly to fulfill such technical need.

Technical Data Comparisons Among Gray Iron Alloy (GI), HPI Alloy and CGI Alloy:

Some ranges of mechanical and physical properties taken from commercial casts were followed to compare traditional gray iron (GI); high performance iron (HPI) and compact graphite iron (CGI):

| | GI | HPI | CGI |
|---|---|---|---|
| Heat Transfer Rate (W/m °K): | ≈50 | ≈50 | ≈35 |
| Hardness (HB) | 200 up to 250 | 230 up to 250 | 207 up to 255 |
| Tensile Strength (Mpa) | 180 up to 270 | 300 up to 370 | 300 up to 450 |
| Fatigue Strength (Mpa): By Rotating Banding | ≈100 | ≈180 | ≈200 |
| Thermal Fatigue (Cycles): Temperature Range 50° C.-600° C. | $10.5 \times 10^3$ | $20 \times 10^3$ | $23 \times 10^3$ |
| Machinability (Km): Milling By Ceramic Tool At 400 m/Min Speed | 12 | 10 | 6 |
| Micro Structure | pearlite-ferrite; graph. A, 2/5 | pearlite 100%; graph A, 4/7 | pearlite 100%; compact graph. 80%; ductile graphite 20% |
| Shrinkage Tendency (%) | 1.0 | 1.5 | 3.0 |
| Damping Factor (%): | 100 | 100 | 50 |
| Poisson's Rate: At Room Temperature | 0.26 | 0.26 | 0.26 |

According to the tests above, besides high tensile strength, the HPI alloy presents excellent machinability, damping vibration, thermal conductivity, low shrink tendency and microstructure stability (compatible with gray iron alloys).

The invention claimed is:

1. A high resistance gray iron alloy comprising, in weight, iron and

C in an amount of 2.8% to 3.2%;

Si in an amount of 2.0% to 2.40%;

Mn in an amount of 0.4% to 0.5% and S in an amount defined in specific ranges by a ratio Mn/S:

when Mn is 0.40% Mn/S is 3.3 to 3.9 when Mn is 0.47% Mn/S is 4.0 to 5.0;

when Mn is 0.50% Mn/S is 4.9 to 6.0;

Cr in an amount of 0.4% maximum and dependent upon an amount of Mo, wherein Cr+Mo is less than or equal to 0.65%;

Sn and Cu in amounts satisfying 0.010% <Cu/10+Sn<0.021%; and

P in an amount of 0.01% maximum;

wherein the alloy has the following properties:

| | |
|---|---|
| Heat Transfer Rate (W/m °K): | 45 to 60 |
| Hardness (HB) | 230 to 250 |
| Tensile Strength (Mpa) | 300 to 370 |
| Fatigue Strength (Mpa): By Rotating Banding | 170 to 190 |
| Thermal Fatigue (Cycles): Temperature Range 50° c.-600° c. | $20 \times 10^3$ |
| Machinability (Km): Milling By Ceramic Tool At 400 m/Min Speed: | 9 to 11 |
| Micro Structure | pearlite 98-100%; graph A, 4/7 |
| Shrinkage Tendency (%) | 1.0 to 2.0 |
| Damping Factor (%): | 90 to 100 |
| Poisson's Rate: At Room Temperature | 0.25 to 0.27 |

* * * * *

UNITED STATES PATENT AND TRADEMARK OFFICE

CERTIFICATE OF CORRECTION

PATENT NO. : 9,200,351 B2
APPLICATION NO. : 13/201337
DATED : December 1, 2015
INVENTOR(S) : Otto Luciano Mol de Oliveira and Jefferson Pinto Villafort It is certified that error appears in the above-identified patent and that said Letters Patent is hereby corrected as shown below:

In the claims

Claim 1, Column 8, Line 49, after the term "0.010%", delete "<" and insert --≤--.

Claim 1, Column 8, Line 50, after the term "Sn", delete "<" and insert --≤--.

Signed and Sealed this
Seventh Day of June, 2016

Michelle K. Lee

Michelle K. Lee
*Director of the United States Patent and Trademark Office*